United States Patent [19]

Hughes et al.

[11] 4,093,211

[45] June 6, 1978

[54] COMBINATION JUMP ROPE AND FLEXIBLE EXERCISER

[76] Inventors: Thomas E. Hughes, 5908 Ridgewood Rd., Jackson, Miss. 39211; Thomas E. Skornschek, 618 Ashcroft Dr., Brandon, Fla. 33511

[21] Appl. No.: 766,053

[22] Filed: Feb. 4, 1977

[51] Int. Cl.[2] ..... A63B 5/20; A63B 21/14; A63B 21/30

[52] U.S. Cl. ..... 272/68; 272/75; 272/137; 272/142

[58] Field of Search ..... 272/74, 75, 67, 68, 272/116, 135, 136, 137, 138, 139, 142, 143, DIG. 4

[56] References Cited

U.S. PATENT DOCUMENTS

| | | | |
|---|---|---|---|
| 708,242 | 9/1902 | Moseley | 272/68 |
| 740,443 | 10/1903 | Korth | 272/143 |
| 992,272 | 5/1911 | Singer | 272/142 |
| 1,010,015 | 11/1911 | Caddy | 272/75 |
| 1,026,215 | 5/1912 | Korth | 272/68 |
| 2,498,006 | 2/1950 | Ridill | 272/142 X |
| 2,592,696 | 4/1952 | Hoody | 272/75 UX |
| 2,814,491 | 11/1957 | Proctor | 272/68 |
| 3,290,043 | 12/1966 | Sorensen | 272/68 |
| 3,637,207 | 1/1972 | Christensen, Jr. | 272/143 |

FOREIGN PATENT DOCUMENTS

| | | | |
|---|---|---|---|
| 605,358 | 2/1926 | France | 272/75 |
| 167,621 | 2/1906 | Germany | 272/139 |

*Primary Examiner*—Richard C. Pinkham
*Assistant Examiner*—Arnold W. Kramer
*Attorney, Agent, or Firm*—Clarence A. O'Brien; Harvey B. Jacobson

[57] ABSTRACT

Exercising apparatus having a pair of handgrips connected to respective ends of an elastic, flexible member to form a jump rope. Suitable clamps are provided for releasably attaching the ends of the flexible member to the handgrips, while the handgrips themselves include handles provided with recesses and grooves for selectively receiving the flexible member and facilitating use of the apparatus as a chest exerciser, and the like. The handgrips are constructed around a torsion spring which permits the handgrips be employed as hand exercising devices.

4 Claims, 10 Drawing Figures

COMBINATION JUMP ROPE AND FLEXIBLE EXERCISER

BACKGROUND OF THE INVENTION

1. Field of the Invention

This invention relates generally to exercising appliances, and particularly to an exercising apparatus which can be used for various exercises, such as rope jumping, hand exercising, arm exercising, and chest exercising, among other exercises.

2. Description of the Prior Art

U.S. Pat. No. 1,010,015, issued Nov. 28, 1911, to S. C. Caddy, discloses a skipping appliance and physical exercising device in which resilient handgrips are attached to a jumping rope. In particular, the handgrips of the Caddy device can be adjusted relative to the rope and the length of the rope shortened insuch a manner as to permit use of the device as a chest exerciser, and the like. Further, U.S. Pat. No. 1,010,796, issued Dec. 5, 1911, to A. A. Pons, discloses an exercising apparatus wherein a length of resilient cord is mounted on a suitable support and is provided at its ends with resilient handles, while U.S. Pat. No. 3,415,515, issued Dec. 10, 1968, to J. H. Otto, discloses a rubber cord skipping rope and exerciser which can be connected to a support as well as used as a skipping rope.

U.S. Pat. Nos. 1,817,616, issued Aug. 4, 1931, to W. F. Goff, and 3,807,730, issued Apr. 30, 1974, to G. E. Dalton, et al., disclose exercising devices having compressible handgrips connected together by flexible members. Particularly, the flexible member of U.S. Pat. No. 3,807,730 is an elastic element which permits the exercising device to be employed for performing chest and similar exercises.

SUMMARY OF THE INVENTION

It is an object of the present invention to provide an exercising apparatus incorporating a jump rope and flexible exercising element in which the construction of the device is safe both to the person exercising and to any structure, such as floors and walls, in the proximity of the person exercising.

It is another object of the present invention to provide an exercising device including a flexible element wherein the length of the element can be readily adjusted.

It is still another object of the present invention to provide an exercising device which can be used both as a jump rope and as a chest, arms, legs, and torso exerciser of variable length and tension.

These and other objects are achieved according to the present invention by providing an exercising device having: a pair of handgrips; an elastic flexible member having two spaced ends connected to the handgrips, with a member being arranged extending between the handgrips; and clamps for releasably attaching the ends of the flexible member to their associated handgrips.

Each of the clamps preferably has a frame forming a longitudinal trough arranged for receiving an associated one of the ends of the flexible member, with a cam lever pivotally mounted on the frame and arranged for selectively gripping the associated end of the flexible member and holding same in the frame.

Each of the handgrips advantageously is resilient and includes a torsion spring provided with normally diverging arms, and two handles, one of the handles mounted on one of the arms and the other of the handles on the other of the arms. One of the handles of each of the handgrips is provided with a recess for selectively receiving the flexible member and permitting the apparatus to be employed as a chest exerciser, while the other of the handles of each of the handgrips is provided with a groove perpendicular or transverse, to the recess provided in the one of the handles for receiving the flexible member and facilitating performance of certain exercises.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 8 is a perspective view showing an exercising apparatus according to the present invention arranged for use as a chest exerciser, and the like.

DESCRIPTION OF THE PREFERRED EMBODIMENTS

Figure 1:
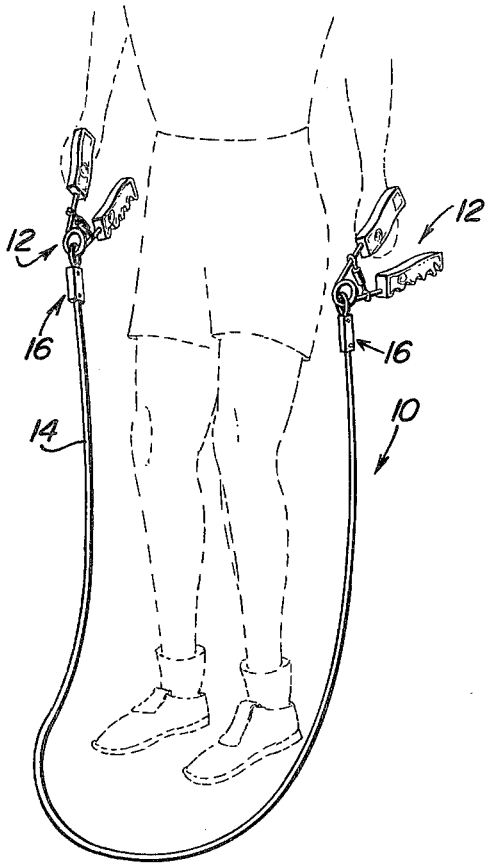
FIG. 1 is a fragmentary, perspective view showing an exercising apparatus according to the present invention being used as a jump rope.

Referring now more particularly to FIG. 1 of the drawings, an exercising apparatus 10 according to the present invention includes a pair of handgrips 12 and an elastic, flexible member 14 having two spaced ends connected to the handgrips 12, with the member 14 being arranged extending between handgrips 12 so as to be used as a, for example, jump rope as is seen in FIG. 1. Clamps 16 are provided for releasably attaching the ends of the flexible member 14 to handgrips 12.

Figure 2:
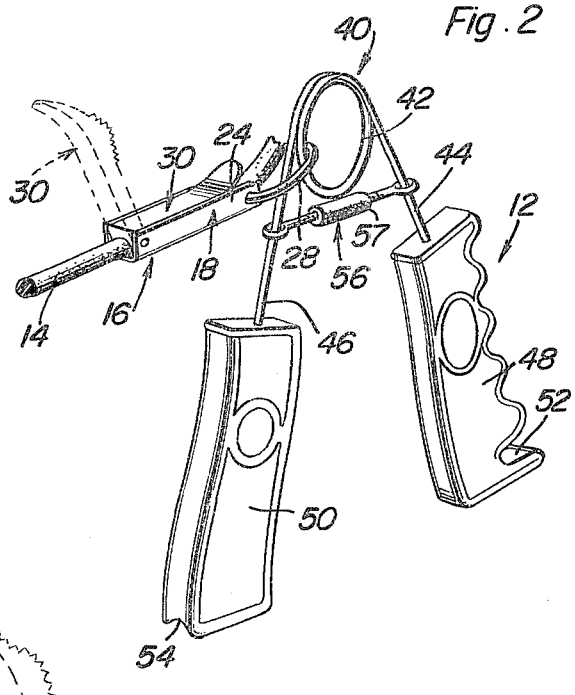
FIG. 2 is a fragmentary, perspective view showing one handle of the apparatus as seen in FIG. 1, together with an end of the flexible member and a clamp according to the invention which releasably attaches the end of the flexible member to its associated handgrip.
Figure 3:
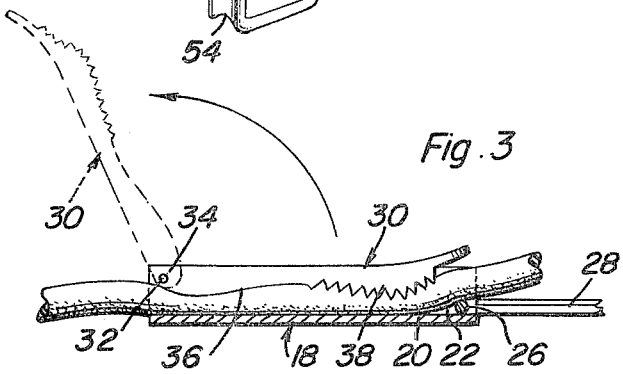
FIG. 3 is an enlarged, vertical, longitudinal sectional view showing the clamp seen in FIG. 2.

As can be seen from FIGS. 2 and 3, each of the clamps 16 includes a frame 18 formed by three longitudinally extending walls 20, 22, and 24, arranged as a back or bottom wall and two side walls in order to form a longitudinal trough receiving an associated one of the ends of flexible member 14. Apertures 26 are provided in the side walls 22 and 24 for receiving a resilient split ring 28 which connects the frame 18 to an associated handgrip 12. A cam lever 30 is pivotally attached to frame 18 as by a pin 32 mounted in the side walls 22 and 24 at an end of frame 18 spaced longitudinally from apertures 26. Holes 34 can be provided in side walls 22, 24 for receiving pin 32. This cam lever 30 is arranged for selectively gripping the associated end of flexible member 14 and holding same in frame 18, and for this purpose is provided with a gripping surface 36 including a serrated portion 38 which will positively engage the circumferential portion of the respective ends of flexible member 14 so as to assure that clamp 16 will securely hold member 14 during performance of various exercises possible with apparatus 10 which will apply substantial force to the connection made by clamp 16.

Figure 4:
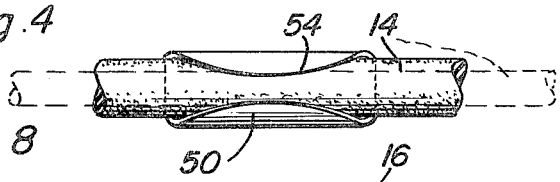
FIG. 4 is a bottom plan view showing the left hand handgrip of the handle seen in FIG. 2.

Referring now more particularly to FIGS. 2 and 4 of the drawings, it will be seen that each of the handgrips 12 is resilient and includes a torsion spring 40 provided with a coil 42 and arms 44 and 46 which normally diverge away from coil 42. Each handgrip 12 also includes a pair of handles 48 and 50, each extending longitudinally away from torsion spring 40, with the handle 48 being mounted on arm 44 and the handle 50 being mounted on arm 46. By this arrangement, it will be appreciated that each handgrip 12 can function as a hand exercising device.

Handle 48 of each handgrip 12 is provided with a recess 52 extending transverse to the longitudinal extent of the handle 48 away from torsion spring 40 and near the lower or free end of the handle selectively receiving member 14 and permitting the apparatus to be employed as a, for example, chest exerciser. Further, handle 50 of each of the handgrips 12 is provided with a groove 54 disposed perpendicularly to recess 52 so as to extend along the bottom or end surface of handle 50 in a direction extending toward and away from handle 48 and toward torsion spring 40 for receiving flexible member 14 and facilitating performance of certain arm exercises, and the like.

Each handgrip 12 is also provided with a latch 56 in the form of two pieces of bent wire, and the like, each having one end threaded to receive a knurled turnbuckle 57 and each having a loop disposed receiving an associated one of the arms 44, 46 of torsion spring 40. By this arrangement, the lateral spread of the handles 48, 50 can be adjusted by turning the knurled turnbuckle 57 to increase or decrease grip size and travel. This feature allows the user to adjust the grip to his own hand size and control the movement to suit the desired exercise.

Figure 5:
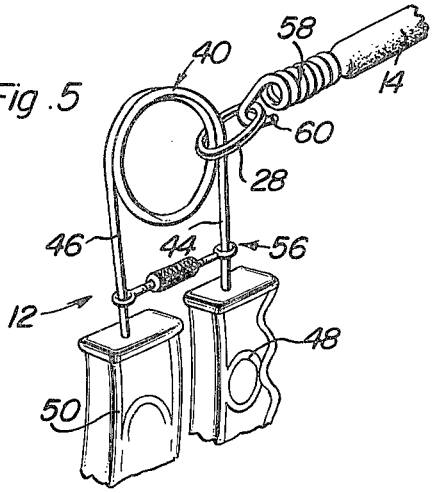
FIG. 5 is a fragmentary, perspective view, similar to FIG. 2, but showing a modified form of the invention.

FIG. 5 of the drawings discloses a modified form of the present invention wherein each end of flexible member 14 can be attached to an associated handgrip 12 as by a coil connector 58 which wraps around the end of member 14 so as to positively grip same and has projecting from the outer or free end thereof a hook 60 which engages with ring 28 in order to achieve the desired attachment.

Figure 6:
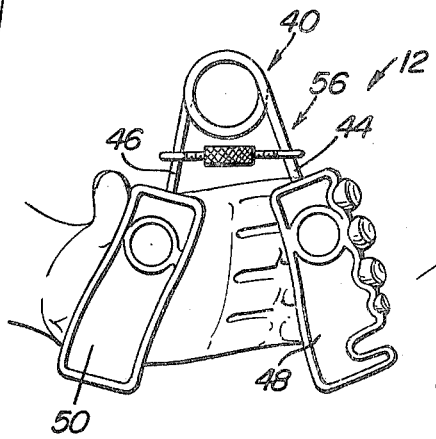
FIG. 6 is a schematic, side elevational view showing one position of a handle for an exercising apparatus according to the invention.
Figure 7:
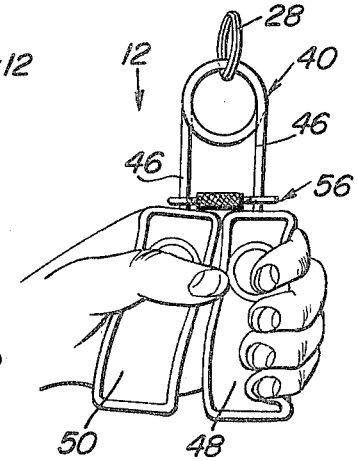
FIG. 7 is a schematic, side elevational view, similar to FIG. 6, but showing another position of the handle for an exercising apparatus according to the present invention.

As can be seen from FIGS. 6 and 7 of the drawings, each handgrip 12 is arranged such that the handles 48 and 50 thereof can be readily grasped by a hand of one desiring to exercise. As seen in FIG. 6, the torsion spring 40 normally biases the handles 48, 50 away from one another. When one grips the handles 48 and 50 with his hand, however, application of sufficient force will overcome the bias of spring 40 and draw handles 48 and 50 toward one another until they are immediately adjacent as seen in FIG. 7. It will be noted that the latch 56 will drop downwardly, assuming the handgrips 12 are disposed in the illustrated upright position, so as to become adjacent the upper ends of the handles 48, 50. If now the handles 48 and 50 are released, latch 56 will limit the movement of handles 48 and 50 away from one another under the bias of spring 40. Of course, if one intends to exercise the hands by repeated closing of the handles 48, 50 toward one another the full possible distance, the handgrip 12 can be oriented such that latch 56 will not limit the expansive movement of torsion spring 40 once the hand pressure on the handles 48 and 50 is released.

Figure 8:
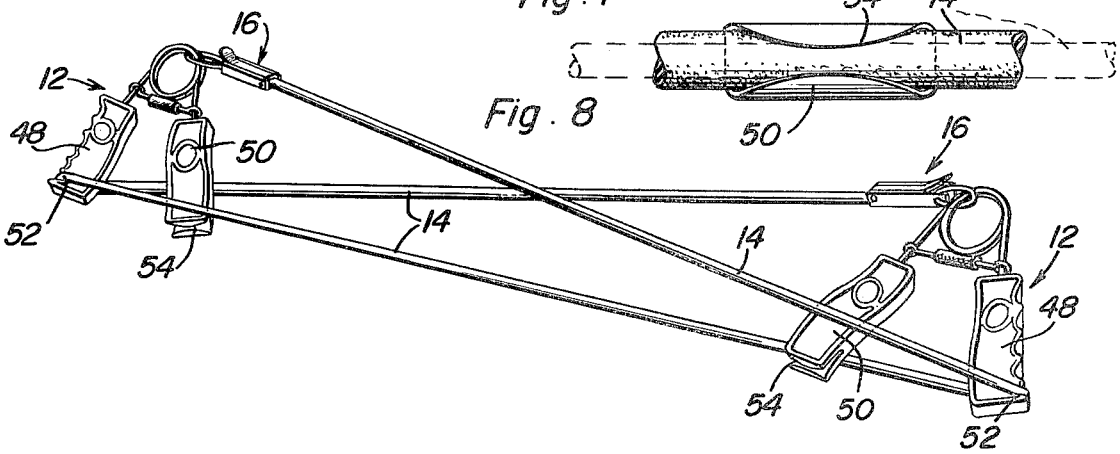
Figure 10:
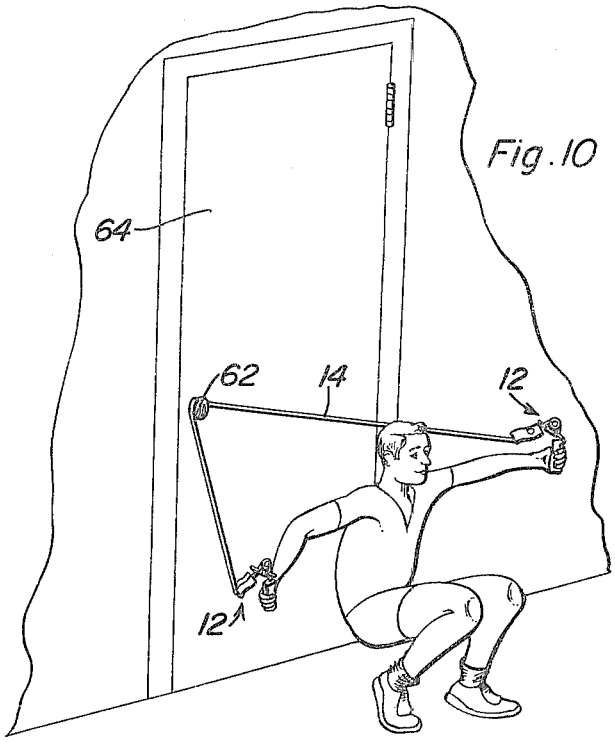
FIG. 10 is a schematic, perspective view showing the flexible member of an exercising apparatus according to the invention wrapped around a door knob in order to permit use of the apparatus to exercise one's back and shoulders.
Figure 9:
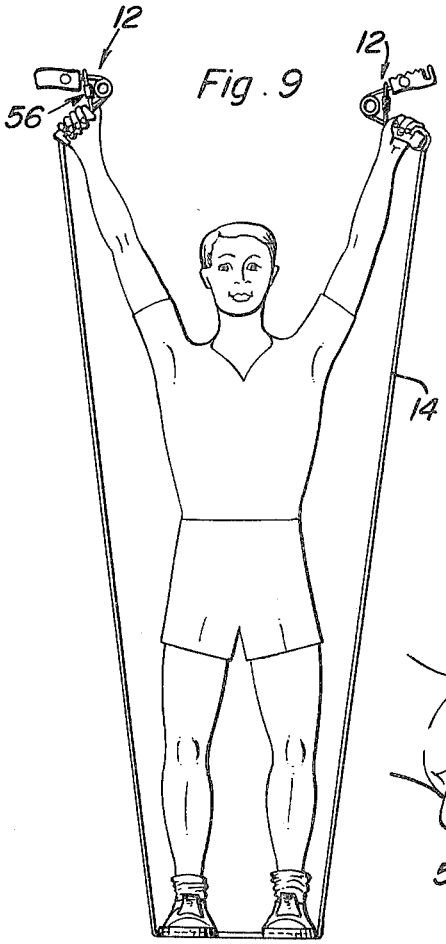
FIG. 9 is a schematic, front elevational view, showing an exercising apparatus according to the present invention being employed for exercising one's arms.

Several examples of exercises which can be carried out with apparatus 10, other than the rope jumping of FIG. 1 and the hand exercising of FIGS. 6 and 7, are illustrated in FIGS. 8 through 10 of the drawings. More specifically, FIG. 8 shows an arrangement wherein the flexible member 14 is disposed in the recesses 52 provided on the handles 48 of each handgrip 12 in order to arrange apparatus 10 as a chest exercising device, and the like, while FIG. 9 shows the flexible member 14 disposed in the grooves 54 provided in the bottom portions of the handles 50 of each of the handgrips 12. By the latter arrangement, the handles 50 function as fulcrums for stretching the elastic, flexible member 14 during various arm and torso exercises, and the like. Further, the user in FIG. 9 may grip handles 48 instead of handles 50. As will be appreciated, the member 14 will decrease in diameter slightly as it is stretched, while decrease in diameter is illustrated in exaggerated form by the broken lines shown in FIG. 4.

FIG. 10 shows an application of an apparatus 10 according to the invention wherein the flexible member 14 is wrapped around a conventional knob 62 of a door 64. This arrangement anchors the flexible member 14 thus permitting various exercises involving the back, shoulders, and other parts of the body, to be readily performed.

A particularly advantageous feature of the present invention is that the clamps 16 readily permit a flexible member 14 to be disconnected from the handgrips, and a member 14 of different length to be incorporated into apparatus 10. By this arrangement, an apparatus 10 can be easily and inexpensively tailored to the length requirements of a particular user. That is, the flexible member 14 may be shortened to desired size, or replaced after excessive wear, or to incorporate stronger or lighter tensioned flexible member 14. Handgrips 12 and flexible member 14 are interchangeable so that one handgrip 12 may have light tension, and the other handgrip 12 medium or heavy tension. The latter would be advantageous for physical therapy, in cases where the family would use the device jointly, and for individuals engaged in a program of progressive exercise. The particular shape of surface 36 of the cam lever 30 is important, inasmuch as it causes to cam lever 30 to be biased, or cammed, clockwise as seen in FIG. 3 in order to assure that the serrated portion 38 will remain in positive engagement with the flexible member 14. The latter can advantageously be constructed of a soft core formed by elastic strands constructed from rubber, and the like, sheath in a suitable woven fabric. This construction of flexible member 14 will resist twisting, the more so because of the manner in which the ends of flexible member 14 are attached to the handgrips 12. Thus, the manner in which the handgrips 12, or one of the handles 48, 50 thereof, are held by one exercising is not critical to the prevention of twisting of the flexible member 14. A swivel or ball bearing attachment (not shown) can be used for the connection in place of ring 28 to provide even greater protection against twisting of member 14.

As can be understood from the above description and from the drawings, an exercising apparatus according to the invention provides for: adjustable length; replaceable components; variable tensions; and hand, finger, wrist, and forearm exercising features in a simple and economical, yet rugged and reliable construction.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In an exercising apparatus, comprising, in combination:

a. a pair of handgrips;

b. an elastic, flexible member having two spaced ends connected to the handgrips, with the member being arranged extending between the handgrips; and c. fastening means attached to the handgrips for attaching the ends of the flexible member to the handgrips; the improvement wherein:

d. each of the handgrips is resilient and includes a torsion spring provided with normally diverging arms, and two handles, one of the handles mounted on one of the arms and the other of the handles on the other of the arms, and each of the handles extending longitudinally away from the torsion spring, one of the handles of each of the handgrips being provided adjacent an end of the handle spaced farthest from the torsion spring with a recess means extending part way around the handle and substantially transverse to the longitudinal extent of the handle for selectively receiving the flexible member and permitting the apparatus to be employed as a chest exerciser by wrapping the flexible member around the one of the handles of each of the handgrips, the other of the handles of each of the handgrips being provided on an end of the handle spaced farthest from the torsion spring with a groove means disposed extending perpendicularly to the recess means provided in the one of the handles and toward the torsion spring for receiving the flexible member and facilitating performance of certain exercises by using the other of the handles of each of the handgrips as a fulcrum for the flexible member.

2. An improvement as defined in claim 1, wherein the fastening means includes a pair of clamps, each of the clamps comprising, in combination:

1. a frame forming a longitudinal trough arranged for receiving an associated one of the ends of the flexible member; and

2. a cam lever pivotally mounted on the frame and arranged for selectively gripping the associated end of the flexible member and holding same in the frame, the cam lever forming gripping means for holding the flexible member more tightly when a pulling action is applied to the flexible member relative to the frame of the clamp.

3. An improvement as defined in claim 2, wherein each of the handgrips includes adjustable latch means attached to the arms of an associated one of the handgrips for adjusting lateral spread of the handles.

4. An improvement as defined in claim 1, wherein each of the handgrips includes adjustable latch means attached to the arms of an associated one of the handgrips for adjusting lateral spread of the handles.

* * * * *